United States Patent [19]

Murphy et al.

[11] Patent Number: 4,519,748

[45] Date of Patent: May 28, 1985

[54] MICRO-PROCESSOR CONTROL OF COMPRESSION RATIO AT FULL LOAD IN A HELICAL SCREW ROTARY COMPRESSOR RESPONSIVE TO COMPRESSOR DRIVE MOTOR CURRENT

[75] Inventors: David A. Murphy, Chambersburg, Pa.; Peter C. Spellar, Hagerstown, Md.

[73] Assignee: Frick Company, Waynesboro, Pa.

[21] Appl. No.: 659,039

[22] Filed: Oct. 10, 1984

Related U.S. Application Data

[63] Continuation of Ser. No. 453,988, Dec. 28, 1982, abandoned, which is a continuation-in-part of Ser. No. 416,768, Sep. 10, 1982, abandoned.

[51] Int. Cl.[3] ..... F04B 49/06; F01C 1/16

[52] U.S. Cl. ..... 417/45; 417/280; 417/282; 417/310; 418/201

[58] Field of Search ..... 417/280, 282, 310, 45; 418/201

[56] References Cited

U.S. PATENT DOCUMENTS

| | | | |
|---|---|---|---|
| 2,418,835 | 4/1947 | Haugsted . | |
| 3,380,650 | 4/1968 | Drummond et al. . | |
| 3,535,053 | 10/1970 | Jednacz | 417/18 |
| 3,648,479 | 3/1972 | Richardson | 62/217 |
| 3,855,515 | 12/1974 | Hutchins, Jr. | 417/384 |
| 4,076,461 | 2/1978 | Moody et al. | 417/310 |
| 4,080,110 | 3/1978 | Szymaszek | 417/280 |
| 4,249,866 | 2/1981 | Shaw et al. | 417/280 |
| 4,351,160 | 9/1982 | Kountz et al. | 62/201 |
| 4,388,048 | 6/1983 | Shaw et al. | 418/201 |

*Primary Examiner*—Richard E. Gluck
*Attorney, Agent, or Firm*—Dowell & Dowell

[57] ABSTRACT

An axial flow helical screw type compressor has a slide valve member and slide stop member mounted end to end beneath the intermeshing rotors such that the slide valve member controls communication between the work chamber defined by the rotors and the casing to the outlet port and the slide stop member and the valve member together control the working fluid inlet to the bores of the rotors, the slide valve member and the slide stop being independently movable. Control means for the slide valve member and slide stop include position sensing means for these two members, inlet and outlet pressure sensing means, and means for feeding these inputs into programmable circuitry to control the positions of the slide member and slide stop. Additional control means senses the occurrence of full load operation and then causes the slide valve member and slide stop member to move as a closed unit in a given direction, or the reverse, as the compressor drive motor current is sensed, continuously seeking the position at which such current is at a minimum.

8 Claims, 6 Drawing Figures

OIL FROM LUBRICATION SYSTEM
POT. 1
POT. 2
P T
A B

OIL FROM LUBRICATION SYSTEM
POT. 1
POT. 2
P T
A B

MICRO-PROCESSOR CONTROL OF COMPRESSION RATIO AT FULL LOAD IN A HELICAL SCREW ROTARY COMPRESSOR RESPONSIVE TO COMPRESSOR DRIVE MOTOR CURRENT

REFERENCE TO RELATED CO-PENDING APPLICATION

This application is a continuation of application Ser. No. 453,988, filed 12/28/82, now abandoned which is a continuation-in-part application from U.S. Ser. No. 416,768, filed Sept. 10, 1982, now abandoned.

FIELD OF THE INVENTION

This invention relates to helical screw type compressors with axial fluid flow in which means is provided for controlling the internal compression ratio in the compressor at full load in response to a variable of compressor operation.

DESCRIPTION OF THE PRIOR ART

Reference is made to the prior art described in co-pending application Ser. No. 416,768. Additional prior art is as follows.

Haugsted U.S. Pat. No. 2,418,835 senses the driving motor input current to test for centrifugal compressor surging and provides the necessary additional gas input or lower discharge pressure to prevent surging.

Drummond U.S. Pat. No. 3,380,650 discloses means for preventing surging in a centrifugal compressor by sensing the pressure in the discharge line and reducing the outlet volume.

Jednacz U.S. Pat. No. 3,535,053 discloses preventing overloading of a motor driving a centrifugal compressor by sensing current input to the motor and operating the unloading means to reduce the current input to the motor.

Richardson U.S. Pat. No. 3,648,479 discloses evening the current input to two motors driving two centrifugal compressors connected to the same load, and preventing motor overloading by sensing motor current input.

Hutchins U.S. Pat. No. 3,855,515 discloses means provided to minimize current peaks and reduce resonance effects in a stepper type motor.

Szymaszek U.S. Pat. No. 4,080,110 senses motor current and gas inlet pressure or temperature, or gas outlet pressure or temperature, and adjusts the capacity control so as to maintain a predetermined motor input current.

Shaw U.S. Pat. No. 4,249,866, and Kountz et al. U.S. Pat. No. 4,351,160 are further illustrative of the art.

SUMMARY OF THE INVENTION

The present invention is directed to control means for changing the internal compression ratio in the compressor when it is operating under full load conditions and simultaneously sensing the compressor drive motor current. The compression ratio is changed by moving a composite valve which interfaces with the compressor rotors. The composite valve is moved in one direction, as determined by an associated computer program, so long as the sensed current decreases. When the current begins to increase the direction is reversed, and so forth. Should suction pressure drop below a predetermined "set point" the valve sections are separated to permit the compressor to operate at less than full load.

DESCRIPTION OF THE PREFERRED EMBODIMENT

Figures 1, 2, 3:
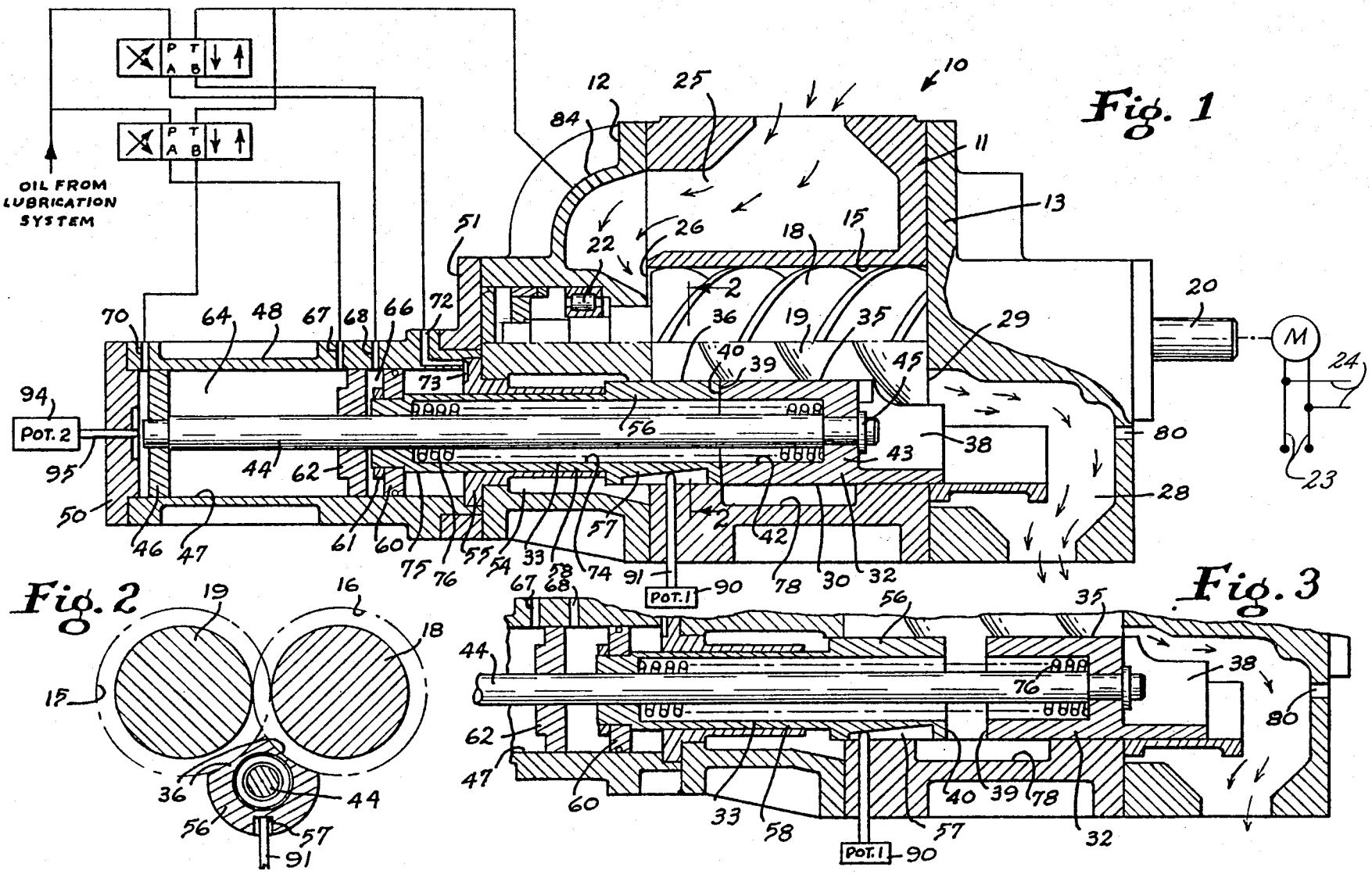
FIG. 1 is a horizontal sectional view of a screw type compressor in accordance with the present invention with portions broken away for clarity.
FIG. 2 is a sectional view of a portion of the compressor taken on the line 2—2 of FIG. 1.
FIG. 3 is a view similar to FIG. 1 illustrating the slide valve and slide stop in positions differing from those of FIG. 1.
Figure 4:
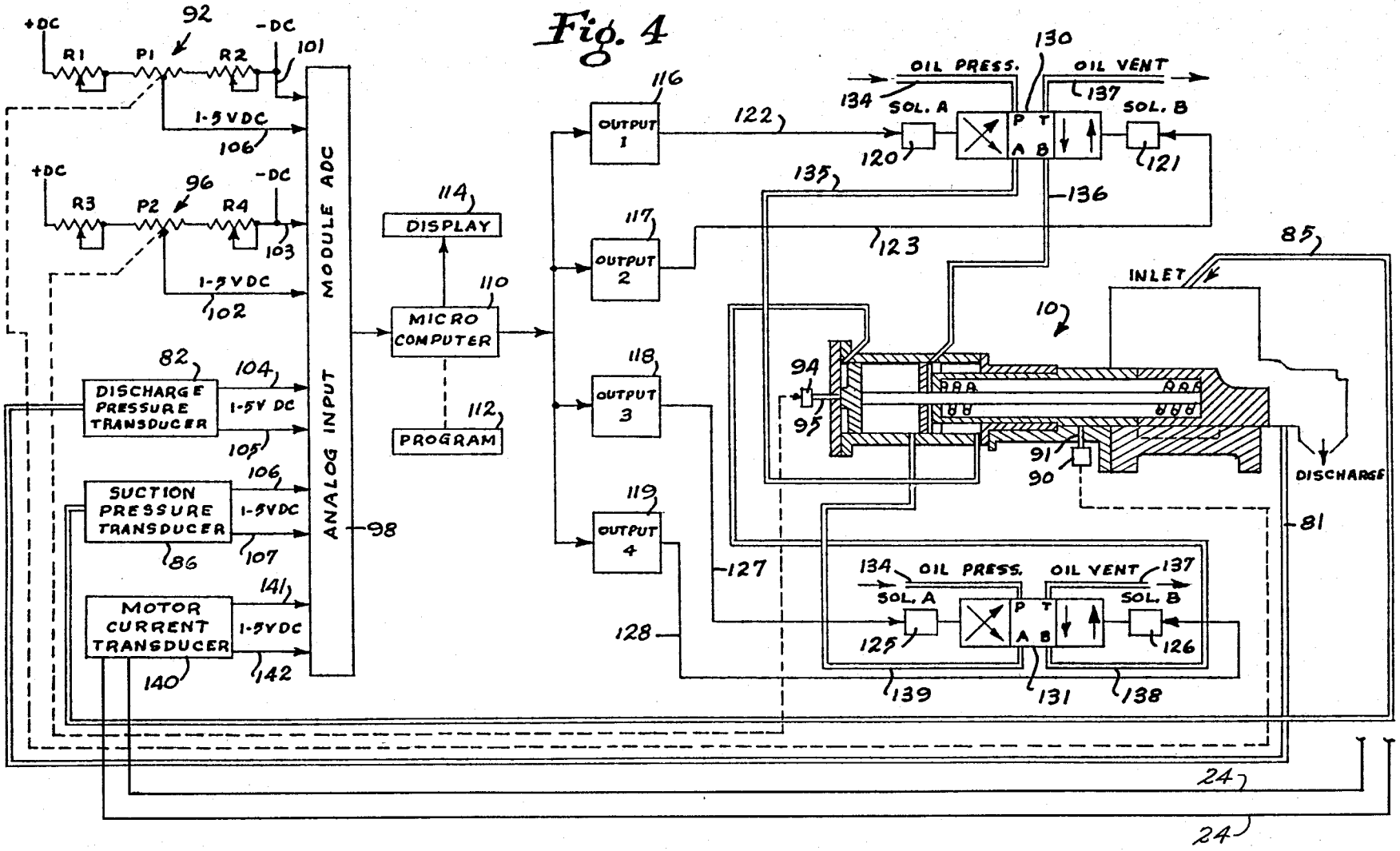
FIG. 4 is a schematic view including the control circuitry.

With further reference to the drawings, particularly FIGS. 1 to 4, a helical screw compressor 10 is illustrated having a central rotor casing 11, an inlet casing 12, and an outlet casing 13 connected together in sealing relationship. The rotor casing has intersecting bores 15 and 16 providing a working space for intermeshing male and female helical rotors or screws 18 and 19 mounted for rotation about their parallel axes by suitable bearings.

Rotor 18 is mounted for rotation on shaft 20 carried in a bearing (not shown) in outlet casing 13, and in bearing 22 carried in inlet casing 12. Shaft 20 extends outwardly from the outlet casing for connection to a motor through a suitable coupling (not shown). The motor may be powered electrically through leads 23, the current of which is sensed through conductors 24 for purposes which will be described.

The compressor has an inlet passageway 25 in inlet casing 12 communicating with the working space by port 26. A discharge passageway 28 in outlet casing 13 communicates with the working space by port 29 (which is at least partially within the outlet casing 13).

It will be apparent in the illustrated embodiment that in a horizontally positioned machine inlet port 26 lies primarily above a horizontal plane passing through the axes of the rotors and outlet port 29 lies primarily below such plane.

Positioned centrally beneath the bores 15 and 16, and having a parallel axis, is a longitudinally extending, cylindrical recess 30 which communicates with both the inlet and outlet ports.

Mounted for slideable movement in recess 30 is a compound valve member including a slide valve 32 and cooperating member or slide stop 33. The innerface 35 of the slide valve, and the innerface 36 of the slide stop are in confronting relation with the outer peripheries of the rotors 18 and 19 within the rotor casing 11.

The right end of the slide valve (as viewed in FIG. 1) has an open portion 38 on its upper side providing a radial port communicating with the outlet port 29. The left end 39 may be flat or shaped as desired to fit against the right end 40 of the slide stop in order that engagement of the two adjacent ends of the slide valve and slide stop will seal the recess 30 from the bores 15 and 16.

The slide valve has an inner bore 42 and a head 43 at one end. A rod 44 is connected by fastening means 45 at one end to the head through which it extends and at its other end to a piston 46. The piston is mounted to reciprocate in the barrel 47 of cylinder 48 which is connected to and extends axially from the inlet casing 12. A cover or end plate 50 is mounted over the outer end of the cylinder 48. The inlet casing 12 is connected to the cylinder 48 by an inlet cover 51 which receives a reduced diameter end portion 52 of cylinder 48.

Mounted interiorly of the inlet cover 51 is a sleeve 54 having a bulkhead portion 55 at one end and extending longitudinally towards the rotor casing. The slide stop 33 has a head portion 56 terminating in the end 40 and the head portion having an inclined slot 57 on its underside sloping upwardly from left to right as viewed in the drawing. The axial length of the slot is adequate to permit the maximum desired movement of the slide stop. From the head portion the slide stop has a main portion 58 which is slideably received within the sleeve 54. At its other end the slide stop has a piston 60 secured by suitable fastening means 61.

A stationary bulkhead 62 is fixed in the cylinder 48 intermediate its ends and separates the interior into an outer compartment 64 in which piston 46 moves, and an inner compartment 66 in which piston 60 moves. Cylinder 48 has fluid ports 67 and 68 closely adjacent each side of the bulkhead 62 communicating with the compartments 64 and 66, respectively. At the outer end of cylinder 48 a fluid port 70 is provided in communication with the compartment 64 but on the opposite side of piston 46. At its inner end the cylinder 48 has port 72 communicating with recess 73 in the outer end face of the bulkhead portion 55 of the sleeve 54 for introducing and removing fluid from the compartment 66 but on the opposite side of piston 60 from the port 68.

The slide stop has an inner bore 74 of matching diameter to that of bore 42 in the slide valve 32 and communicating with that bore. At its other end the slide stop has a head 75 which mounts the piston 60.

A self-unloading coil spring 76 is positioned in the coaxial bores 74 and 42, around rod 44, and tends to urge the slide valve 32 to closed position and to urge the slide stop into abutting relation with the bulkhead 62. In such position the slide valve and slide stop are spaced apart a maximum distance.

In operation the working fluid, such as a refrigerant gas enters the compressor by inlet 25 and port 26 into the grooves of the rotors 18 and 19. Rotation of the rotors forms chevron shaped compression chambers which receive the gas and which progressively diminish in volume as the compression chambers move toward the inner face of the outlet casing 13. The fluid is discharged when the crests of the rotor lands defining the leading edge of a compression chamber pass the edge of port 38 which communicates with the discharge 28. Positioning of the slide valve 32 away from the outlet casing 13 reduces the compression ratio by enlarging the final compression chamber. Positioning towards the outlet casing when the slide valve and slide stop are together has the opposite effect. Thus, movement of the slide valve varies the compression ratio and the pressure of the gas discharged from the compressor.

The compressor and its control means is operated to continuously vary and seek the optimal compression ratio based on the lowest current required for driving the compressor motor, under full load conditions. Thus, as will be described, the slide valve and slide stop may be controlled as a composite unit to vary the internal compression ratio in the compressor as the motor current is sensed, to find the position that results in the lowest possible current. Should a requirement for unloading occur the slide valve and slide stop are moved apart, as indicated in FIG. 3. The space therebetween then communicates with the intermeshed rotors 18 and 19 to permit working fluid in a compression chamber between the rotors at inlet pressure to remain in communication with the inlet through slot 78 and a passageway (not shown) in casing 11 thereby decreasing the volume of fluid which is compressed and causing the compressor to operate at less than full load.

THE CONTROL SYSTEM

The present invention includes a control system for moving the slide valve and slide stop in accordance with a predetermined program to accomplish the aforestated objectives. In order to do this four variables from the compressor are constantly sensed and fed into an electrical network. Thus, outlet casing 13 has a plug opening 80 connected by conduit 81 to discharge pressure transducer 82. Inlet casing 12 has plug opening 84 connected by conduit 85 to suction pressure transducer 86. Potentiometer 90 has its movable element 91 extending through the wall of rotor casing 11 and engaged with the inclined slot 57 in the slide stop 33 and functioning as P1 to control voltage divider network 92. Potentiometer 94 has its movable element 95 extending through the cylinder cover 50 into engagement with rod 44 of slide valve 32 and functioning as P2 to control voltage divider network 96. The voltage divider network 92 includes calibration resistors R1 and R2 and transmits a 1–5 voltage DC signal to the analog input module 98 by lines 100 and 101. Similarly, voltage divider network 96 includes calibration resistors R3 and R4 and feeds a 1–5 DC signal to the analog input module 98 by lines 102 and 103.

The discharge pressure transducer 82 and suction pressure transducer 86 convert the signal each received to a 1–5 volt DC signal and sends it by lines 104–107 to analog input module 98.

Module 98 converts the signals it received to digital signals and transmits these to microcomputer 110. Microcomputer 110 has a program 112 of predetermined nature so that the computer output provides the desired control of the slide valve 32 and slide stop 33. An appropriate readout or display 114 is connected to the computer 110 to indicate the positions of the slide valve and the slide stop based on the signals received from the feedback potentiometers 90 and 94.

From the computer 110, four control signals are provided through the outputs 116, 117, 118 and 119. Thus, the two signals from the voltage divider networks 92 and 96, responsive to slide stop and slide valve position, and the two signals from the discharge and suction pressure transducers 82 and 86, are coupled through the analog input to the microcomputer and processed thereby to deliver appropriate outputs 116 through 119. Outputs 116 and 117 are connected to solenoids 120 and 121 through lines 122 and 123, respectively. Outputs 118 and 119 are connected to solenoids 125 and 126 through lines 127 and 128, respectively.

Solenoids 120 and 121 control hydraulic circuits through control valve 130 which position the slide stop 33. Solenoids 125 and 126 control hydraulic currents through control valve 131 which position the slide valve 32.

Control valve 130 is connected by line 134 to a source of oil or other suitable liquid under pressure from the pressurized lubrication system of the compressor. Line 135 connects the valve 130 to fluid port 72 and line 136 connects the valve to fluid port 68. A vent line 137 is connected to the inlet area of the compressor.

Control valve 131 is connected by line 134 to the oil pressure source and by line 137 to the vent. Line 138 connects valve 131 to fluid port 67 and line 139 connects valve 131 to fluid port 70.

In operation, energizing solenoid 120 of valve 130 positions the valve so that flow is in accordance with the schematic representation on the left side of the valve, the flow being from "P" to "B" and thus applying oil pressure via conduit 136 against the left side of piston 60 and simultaneously venting oil from the opposite side of the piston via conduit 135 and in the valve from "A" to "T" to the oil vent. This urges the piston and its associated slide stop to the right, as represented in the drawing.

Energizing solenoid 121 of valve 130 positions the valve so that flow is in accordance with the schematic representation on the right side of the valve, the flow being from "P" to "A" and thus applying oil pressure via conduit 135 against the right side of piston 60 to urge it to the left and simultaneously venting oil from the opposite side of the piston via conduit 136 and in the valve from "B" to "T" to the oil vent.

Similarly, energizing solenoid 125 of valve 131 positions that valve from "P" to "B" to apply pressure through fluid port 70 and venting through fluid port 67 from "A" to "T" to move the slide valve to the right as represented in the drawing. Energizing solenoid 126 of valve 131 positions the valve from "P" to "A" to apply pressure through fluid port 67 and venting through fluid port 70 from "B" to "T" to move the slide valve to the left.

When the compressor is used in a refrigeration system it is normally desired to move its slide valve to maintain a certain suction pressure which is commonly referred to as the "set point". Optionally, other parameters such as the temperature of the product being processed in a refrigeration system associated with the compressor, may be used as factors affecting the position of the slide valve and, hence, the capacity of the compressor. The system of the present invention contemplates entering a desired set point into the microcomputer 110 by appropriate switches connected with a control panel, not shown, associated with the display 114. The control panel may also include provision for controlling the mode of operation, e.g., automatic or manual, and the operation of the slide stop, slide valve, and compressor. The readout display 114 from the microcomputer 110 is based on the signals it receives. The necessary electrical connections are made between the control panel and the microcomputer 110 in order to accomplish the desired function by means well known in the art.

In order to accomplish the purposes of the present invention another variable, compressor motor current is also sensed and fed into the network. Thus, motor current transducer 140 is connected to the motor M, by the conductors 24. The transducer 140 is connected by lines 141 and 142 to the analog input module 98, connected to the microcomputer 110. The microcomputer is programmed to unload the compressor if the motor current exceeds a predetermined value. It accomplishes this by causing appropriate separation of the slide valve and slide stop.

When the microcomputer detects full load operation its program causes the slide valve and slide stop to move together, as a unit, an incremental distance in one direction, as predetermined by the program. If such movement, while operating at full load, causes the sensed motor current to drop, then the computer program causes another incremental movement in the same direction. This continues until the current reaches its lowest level and begins to rise. The program then reverses the direction of movement, again seeking the position at which the current is at a minimum. Should the initial movement of the composite valve cause a rise in current then the program will cause the direction to reverse and continue in such direction until a condition of minimum current is passed.

The feedbacks from the potentiometers for both the slide stop and slide valve are used to determine whether a conflict or overlapping exists between the desired mechanical position of the slide stop and the actual mechanical position of the slide valve. If a conflict exists, the slide valve is temporarily relocated so that the positioning of the slide stop takes precedence.

The system also has provisions whereby appropriate controls indicated on the control panel may be operated to permit manual positioning of both the slide valve and the slide stop.

While hydraulic means has been described for moving the slide stop and slide valve, it is obvious that other means well known to those skilled in the art may be used. For example, electric stepper motors or stepper motor piloted hydraulic means may be used if desired.

DESCRIPTION OF THE MODIFICATION OF FIGS. 5 AND 6

Figure 5:
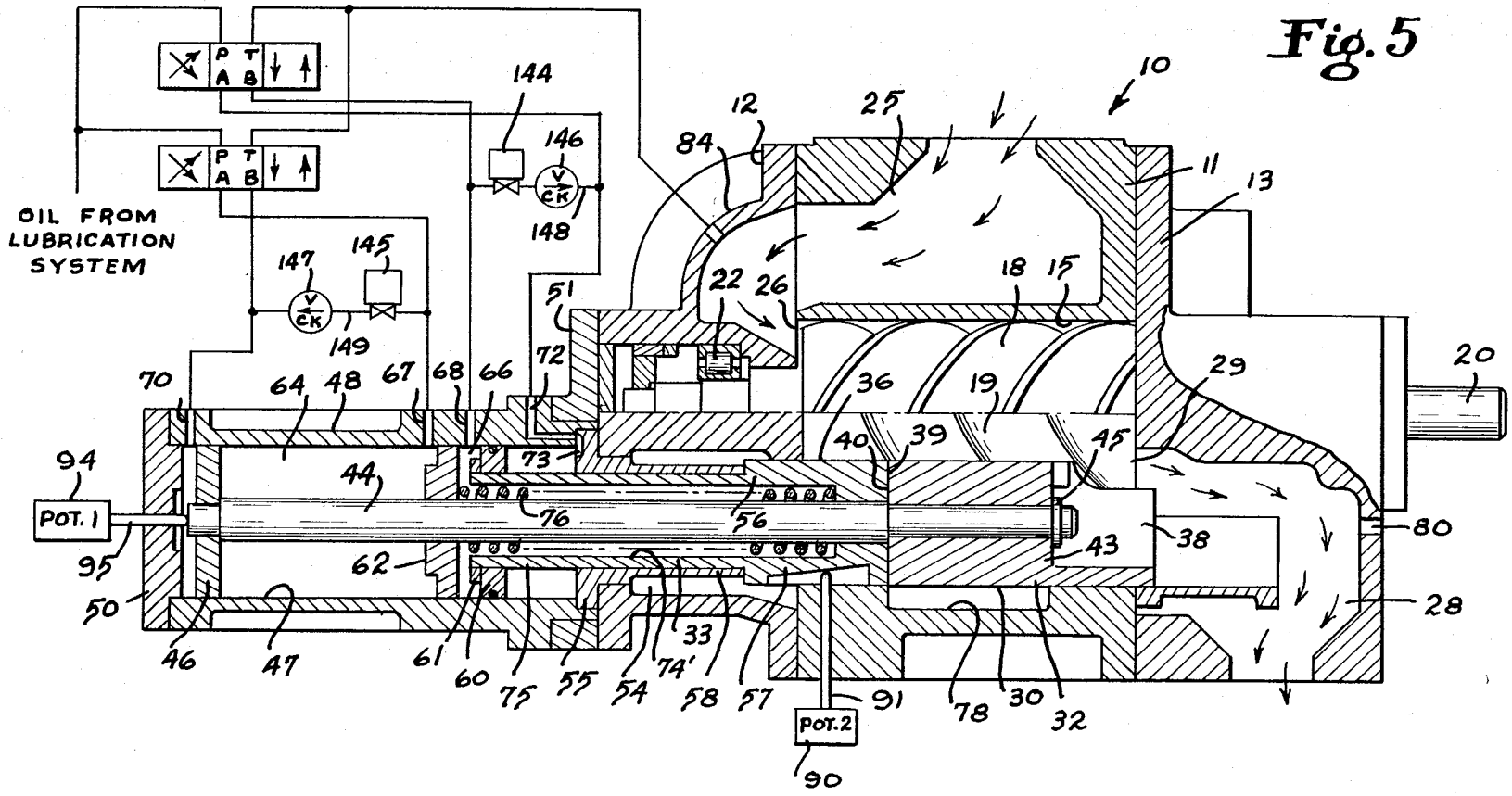
FIG. 5 is a view of the same type as FIG. 1 of a modification.
Figure 6:
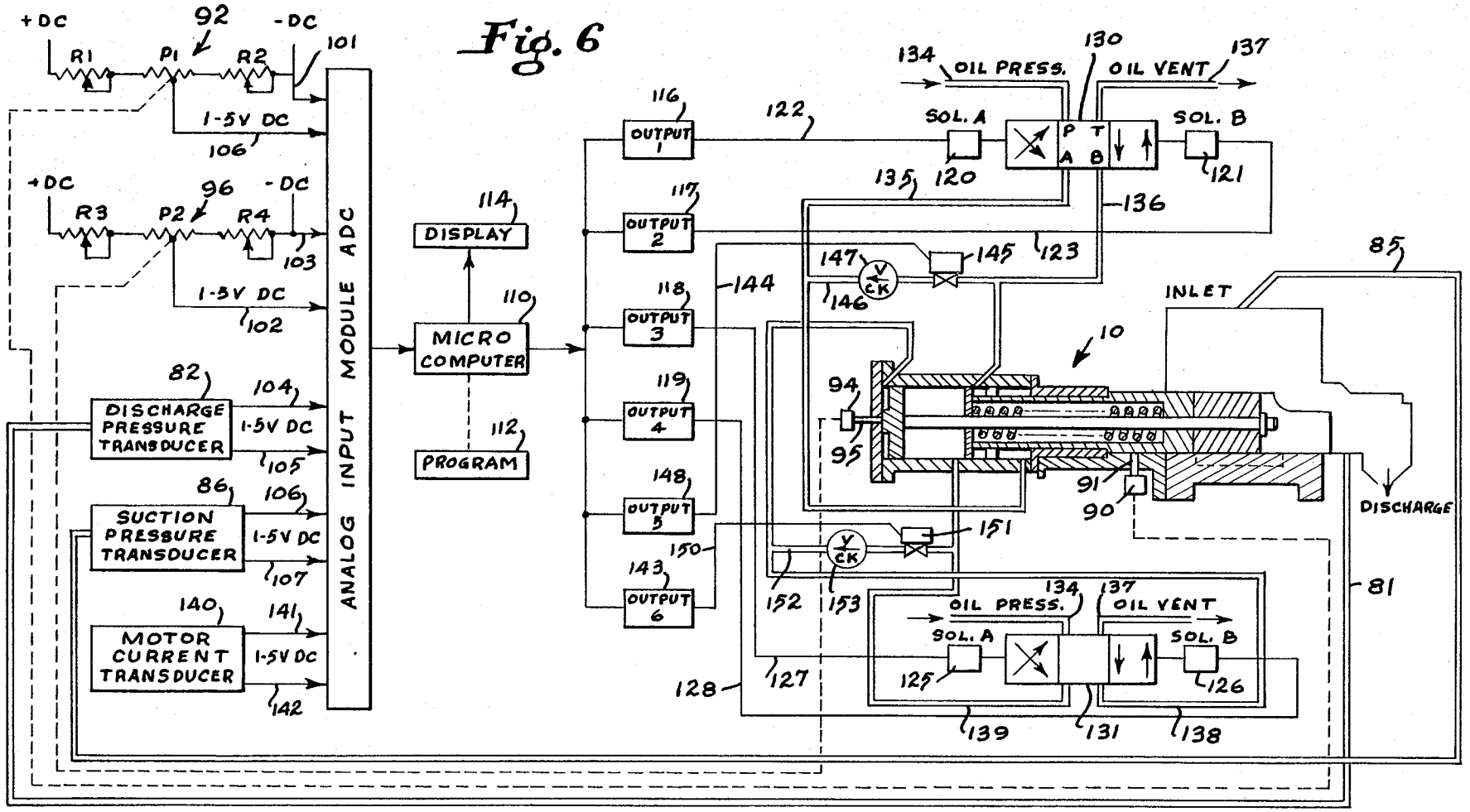
FIG. 6 is a schematic view including the control circuitry of the modification of FIG. 5.

FIGS. 5 and 6 illustrate a modification of the above. Instead of having the spring 76 tend to move apart the slide valve and slide stop as in FIGS. 1 to 4, the spring 76' is mounted around the shaft 44 within the bore 74' of the slide stop only, its left end extending through the slide stop into abutting relation with the bulkhead 62, and its right end abutting the right end of bore 74'. Thus, the spring assists in the movement of the slide stop to the right as viewed in FIG. 5, and opposes its movement to the left. The enlarged bore 42 within the slide valve, illustrated in FIG. 1, is omitted, as shown in FIG. 5.

A further change is the addition of outputs 5 and 6, numbered 148 and 143, connected to the microcomputer 110. Output 5 is connected by line 144 to solenoid 145 which controls flow through bypass line 146 between the lines 136 and 135. A one-way valve 147 in the line 146 is also provided. Output 6 is connected by line 150 to solenoid 151 which controls flow through bypass 152 between the lines 139 and 138, bypass 152 also having a one-way valve 153.

In the operation of the embodiment of FIGS. 5 and 6, when the machine is detected as being at full load the program will move the slide valve and slide stop together a predetermined incremental distance as predetermined by the program. Moving of the slide valve and slide stop together in the right hand direction as viewed in FIGS. 5 and 6, occurs as a result of energizing Sol. A, 120, thus causing hydraulic pressure on the piston 60 to move the piston to the right. Simultaneously solenoid 151 in the bypass line 139 to 138 permits an oil bypass from the right side of piston 46 to the left side of piston 46.

If the movement of the combination to the right while maintaining full load causes the current to drop, then the program would move this combination to the right another increment. This will continue until the current reaches its lowest value and begins to rise. Then the program will move the slide valve and slide stop back in the direction of decreasing current, seeking a null.

Movement of the slide valve and slide stop together in the left direction is accomplished by energizing Sol. B, 126, permitting oil pressure to enter at the right side of piston 46 and energizing bypass solenoid 145, thus permitting oil on the left side of piston 60 to flow to the right side of piston 60.

We claim:

1. In an electric motor driven screw compressor having meshing helical rotors on parallel axes and mounted in a housing having intersecting cylindrical bores, a high pressure end wall at one end of said housing and a low pressure end wall at the other end thereof, the low pressure end wall having an inlet opening and the high pressure end wall having a discharge opening, an axially extending recess in the housing in open communication with said bores, a slide member mounted for axial movement in the recess, said slide member having interfacial sealing relationship with said rotors, said slide member having a discharge face at one end thereof which is adjacent to the high pressure end wall whereby movement of the slide member is operative to change the compression ratio, the improvement comprising, means sensing the magnitude of current to said electric motor, means for sensing when the compressor is operating at full load, means for incrementally moving the slide member in each direction, and means responsive to full load operation for causing the slide member to move in one direction while the motor current is decreasing, to change to the other direction upon an increase in the motor current, to continue to move in said other direction while the motor current is decreasing, and to change back to said one direction upon an increase in the motor current.

2. The invention of claim 1 in which said slide member comprises a slide valve and a slide stop, said slide valve having a rear face at its end remote from its discharge face, said slide stop having a front face which is adapted to engage the slide valve rear face to form a continuous composite member, said slide valve and slide stop being movable apart to provide an opening therebetween of variable selected size and axial position in communication with the inlet opening in order to permit selective unloading of the compressor, means sensing the pressure at said inlet opening, and means operative to cause the slide valve and slide stop to move apart when the inlet pressure drops below a predetermined set point.

3. The invention of claim 1 in which said slide member comprises a slide valve and a slide stop, said slide valve having a rear face at its end remote from its discharge face, said slide stop having a front face which is adapted to engage the slide valve rear face to form a continuous composite member, said slide valve and said slide stop being movable apart to provide an opening therebetween of variable selected size and axial position in communication with the inlet opening in order to permit selective unloading of the compressor, first means sensing the pressure at the discharge opening, second means sensing the pressure at the inlet opening, third means sensing the position of said slide stop, fourth means sensing the position of said slide valve, means responsive to said first, second, third and fourth means and operative to deliver electrical outputs proportional thereto, means connecting said electrical outputs to a microcomputer, said microcomputer being programmed in accordance with predetermined parameters and operative to control the movement of said slide valve and said slide stop.

4. The invention of claim 2, and means continually urging said slide stop towards said slide valve.

5. The invention of claim 2, said slide stop being connected by first rod means to a first piston means, said slide valve being connected by second rod means to a second piston means, said first and second piston means being movable along the same axis, bulkhead means separating the piston means for movement within first and second isolated chamber means, means for introducing and removing fluid into and from said chamber means on each side of said first and second piston means for controlling the movement thereof, said first rod means having an axial bore, said second rod means extending through said slide stop, said bore, said first piston means and said bulkhead means, and compressible means in said bore around said second rod means and engaging said slide stop and said bulkhead means and tending to urge said slide stop towards said slide valve.

6. The invention of claim 5, in which said means for introducing and removing fluid into and from said chamber means on each side of said first and second piston means comprises first means operative to drive said first piston means in one direction, second means operative to permit fluid in said second piston means to bypass from one side of said second piston means to the other side thereof, third means operative to drive said second piston means in the other direction, and fourth means operative to permit fluid in said first chamber means to bypass from one side of said first piston means to the other side thereof.

7. In an electric motor driven screw compressor having meshing helical rotors on parallel axes and mounted in a housing having intersecting cylindrical bores, a high pressure end wall at one end of said housing and a low pressure end wall at the other end thereof, the low pressure end wall having an inlet opening and the high pressure end wall having a discharge opening, and means for selectively and incrementally raising and lowering the internal compression ratio of said compressor, the improvement comprising, means sensing the magnitude of current to said electric motor, means for causing the compression ratio raising and lowering means to operate in one mode while the motor current is decreasing, to change to the other mode upon an increase in the motor current, to continue to operate in said other mode while the motor current is decreasing, and to change back to said one mode upon an increase in the motor current.

8. In an electric motor driven screw compressor having meshing helical rotors on parallel axis and mounted in a housing having intersected cylindrical bores, a high pressure end wall at one end of said housing and a low pressure end wall at the other end, the low pressure end wall having an inlet opening and the high pressure end wall having a discharge opening, an axially extending recess in the housing in open communication with said bores, the improvement comprising, a slide valve mounted for axial movement in the recess, said slide valve having interfacial sealing relationship with said rotors, said slide valve having a discharge face at one end thereof which is adjacent to the high pressure end wall and a rear face at its remote end, a slide stop having a front face which is adapted to engage the slide valve rear face to form a continuous composite member, said slide valve and slide stop being moveable apart to provide an opening therebetween of variable selected size and axial position in communication with the inlet opening in order to permit selective unloading of the compressor, first means sensing the pressure at the discharge opening, second means sensing the pressure at the inlet opening, third means sensing the position of said slide stop, fourth means sensing the position of said slide valve, fifth means sensing the magnitude of current to said motor, pressure transducer means responsive to the first and second means and operative to deliver electrical outputs proportional thereto, electrical circuit means responsive to set third, fourth and fifth means and operative to deliver electrical outputs proportional thereto, means delivering the outputs to a microcomputer, said microcomputer being programmed in accordance with predetermined parameters and operative to control the movement of said slide stop member and said slide valve member, said microcomputer control being operative to move incrementally the slide valve and slide stop in each direction, said microcomputer being programmed responsive to full load operation to cause the slide valve and slide stop to move as a composite member in one direction while the motor current is decreasing, to change to the other direction upon an increase in the motor current, to continue to move in said other direction while the motor current is decreasing, and to change back to said one direction upon an increase in the motor current.

* * * * *